US006157131A

United States Patent [19]

Nelson et al.

[11] Patent Number: 6,157,131

[45] Date of Patent: Dec. 5, 2000

[54] METAL HALIDE LAMP WITH FRAME MEMBERS

[75] Inventors: Gregory J. Nelson, Hammondsport; Franciscus H. van Lierop, Bath; John S. Bailey, Bradford, all of N.Y.

[73] Assignee: Philips Electronics North America Corp., New York, N.Y.

[21] Appl. No.: 09/135,863

[22] Filed: Aug. 18, 1998

[51] Int. Cl.[7] ..... H01J 61/34

[52] U.S. Cl. ..... 313/634; 313/25; 313/292

[58] Field of Search ..... 313/25, 634, 239, 313/292

[56] References Cited

U.S. PATENT DOCUMENTS

| | | | |
|---|---|---|---|
| 4,843,266 | 6/1989 | Szanto et al. | 313/25 |
| 5,594,294 | 1/1997 | Duffy et al. | 313/25 |
| 5,670,840 | 9/1997 | Lanese et al. | 313/25 |
| 5,719,463 | 2/1998 | Hassink et al. | 313/25 |
| 5,731,662 | 3/1998 | Parrott et al. | 313/25 |

FOREIGN PATENT DOCUMENTS

| | | | |
|---|---|---|---|
| 0 784 334 | 7/1997 | European Pat. Off. | H01J 61/30 |
| 0784334 | 7/1997 | European Pat. Off. | H01J 61/82 |
| 06076799 | 3/1994 | Japan | H01J 61/38 |

*Primary Examiner*—Michael H. Day
*Attorney, Agent, or Firm*—F. Brice Faller

[57] ABSTRACT

A quartz protective sleeve surrounding a ceramic metal halide arc tube is supported by a pair of frame members received inside the sleeve. A short frame member extends only partially into the sleeve, while a long frame member extends through the sleeve and includes a loop which engages a dimple at the top of the lamp envelope. The sleeve is fitted over the frame members, which are spring loaded apart. Axial positioning may be provided by terminals or other features fixed to the frame members. In an alternative embodiment, shoulders for positioning the sleeve and terminals for connecting to the arc tube are formed integrally with the frame members.

18 Claims, 2 Drawing Sheets

METAL HALIDE LAMP WITH FRAME MEMBERS

BACKGROUND OF THE INVENTION

The invention relates to a lamp of the type having a protective sleeve of quartz surrounding a light source, in particular a metal halide arc tube.

Protective sleeves of quartz or other transparent material able to withstand operating temperatures are commonly utilized around metal halide arc tubes, also known as high intensity discharge or HID arc tubes, in order to provide protection against non-passive failure during lamp operation. These sleeves act to slow or stop fast moving arc tube fragments and prevent the rupture of the outer lamp envelope. These sleeves may also provide other functions including, but not limited to, reduction of the UV output of the lamp.

These sleeves are typically mounted around the arc tube using additional straps or clips around the outside or in the ends of the sleeve. In the case of quartz metal halide lamps, any metal supports used in the mounting must be kept away from the arc tube or be electrically floating to reduce the rate of sodium loss. An arrangement of this type is disclosed in EP 0 784 334.

Protected mount designs are typically quite expensive and difficult to mechanize. In addition, most mounts are insufficiently rigid and may come apart with rough lamp handling (as during transportation).

SUMMARY OF THE INVENTION

According to the invention, a pair of frame members extend up from the stem and through the inside of the sleeve. These frame members are bent so that they are slightly further apart than the inside diameter of the sleeve so that their spring tension will hold the sleeve. The short frame member only needs to extend about ½ way through the sleeve to provide proper support. The sleeve may be kept from sliding up and down on the mount by the terminal connecting the arc tube to the short frame wire (base end) and by the getter (top end).

This design has the unique feature that the entire mount may be assembled easily in an automated fashion in a 2 dimensional plane. After the mount is complete, the sleeve may be slipped over the mount frame wires if they are pinched slightly together. Upon release, the spring tension holds the sleeve firmly in place. Where the long frame wire is secured in the end of the lamp after sealing, for example engaging the dimple of an ED-type lamp, this mount is extremely secure and is not subject to broken welds or loose clips.

This mount design is intended for a ceramic metal halide arc tube. Because of the close proximity of the electrically charged frame wires to the arc tube, such a mount could not be utilized with a quartz arc tube due to rapid sodium loss. Sodium loss is discussed in Carleton et al., "Metal Halide Lamps with Ceramic Envelopes: A Breakthrough in Color Control", Journal of Illuminating Engineering Society, While the invention is directed in particular to lamps having ceramic metal halide arc tubes, it may also find applicability with incandescent light sources such as the IR coated tungsten-halogen lamp disclosed in U.S. Pat. No. 5,670,840.

DETAILED DESCRIPTION OF THE PREFERRED EMBODIMENTS

Figure 1:
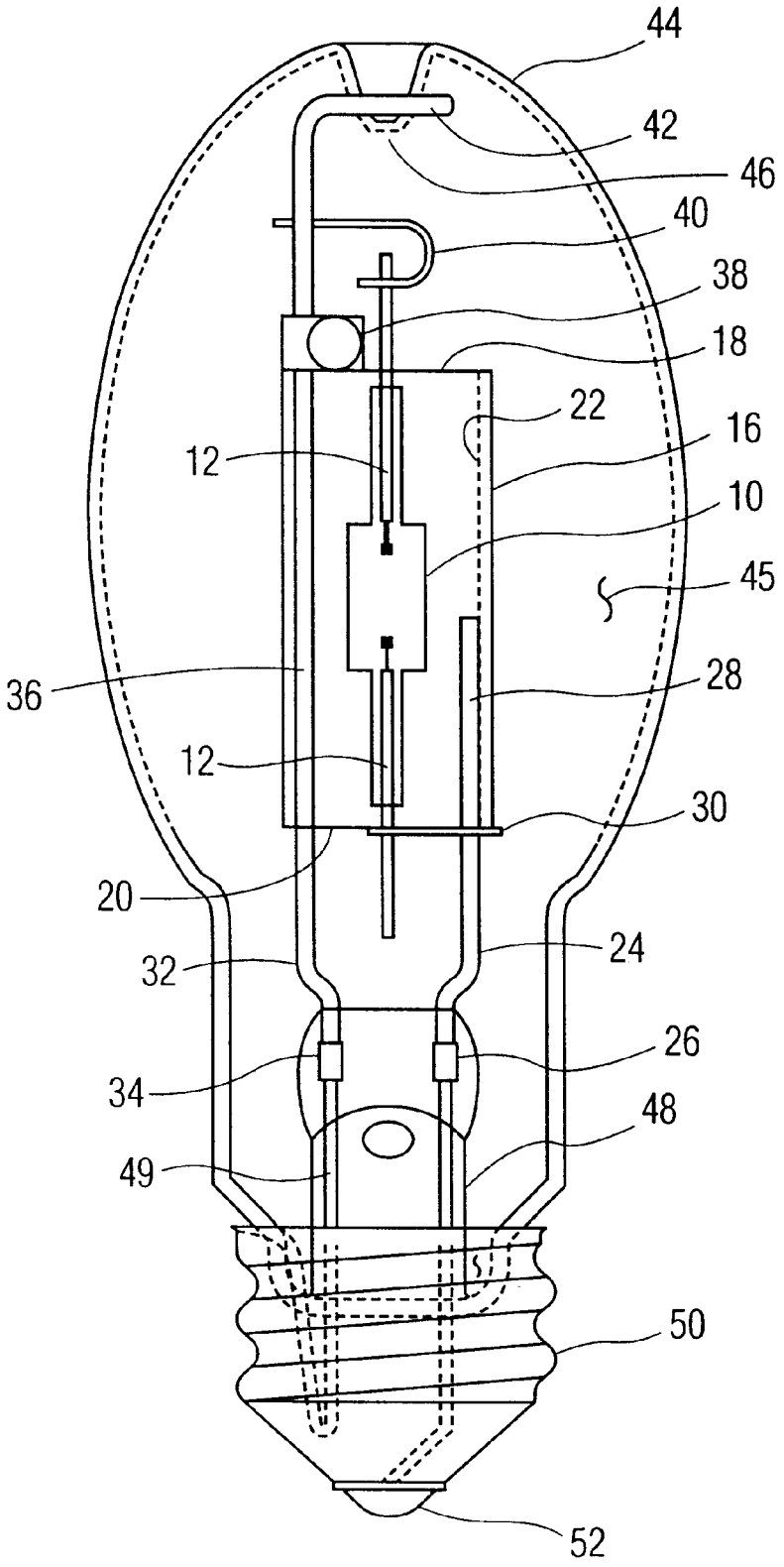
FIG. 1 is an elevation view of a lamp according to the invention.

Referring to FIG. 1, a lamp according to the invention includes a metal halide arc tube 10 having a pair of opposed leads 12 surrounded by a protective sleeve 16 of quartz. The tubular sleeve 16 has an upper end 18, and oppositely facing lower end 20, and an internal surface 22 extending between the ends.

The quartz sleeve 16 is supported by a short frame member 24 and a long frame member 32, both of which are received inside the sleeve 16 and spring loaded outward against the internal surface 22 thereof. The frame members are preferably formed with stainless steel wire, but Mo, Nb, or Ni ire may also be used. The short frame member has a lower end 26 embedded in the stem 48 formed integrally with the glass envelope 44, a straight portion 28 which bears against the internal surface 22, and a welded-on terminal 30. This terminal 30 not only provides an electrical connection to the lower arc tube lead 12, but supports one end 20 of the quartz sleeve 16.

The long frame member 32 has a lower end 34 embedded in the glass stem 48 and a straight section 36 extending through the length of the sleeve 16 and bearing against internal surface 22. A getter 38 fixed to the member 32 bears against the upper end 18 of the quartz sleeve 16 and serves to fix its position. A terminal 40 provides an electrical connection for the upper arc tube lead 12. Beyond this the frame member 32 is provided with an integrally formed loop 42 which fits around a dimple 46 formed in the upper axial end of the glass envelope 44. This stabilizes the frame members 24, 32, the arc tube 10, and the sleeve 16 inside the glass envelope.

The lower ends 26, 34 of the frame members are welded to leads 49 on which the glass stem 48 is formed. The sleeve 16 is then fitted onto the frame members 24, 32 by sliding onto the upper end thereof without any straps or clips outside of the frame members being necessary. The subassembly is then fitted into the glass envelope 44 with loop 42 about dimple 46. The stem 48 is then sealed to the glass envelope and exhausted, the base 50 is fitted, and the insulated contact 52 is fitted.

Figure 2:
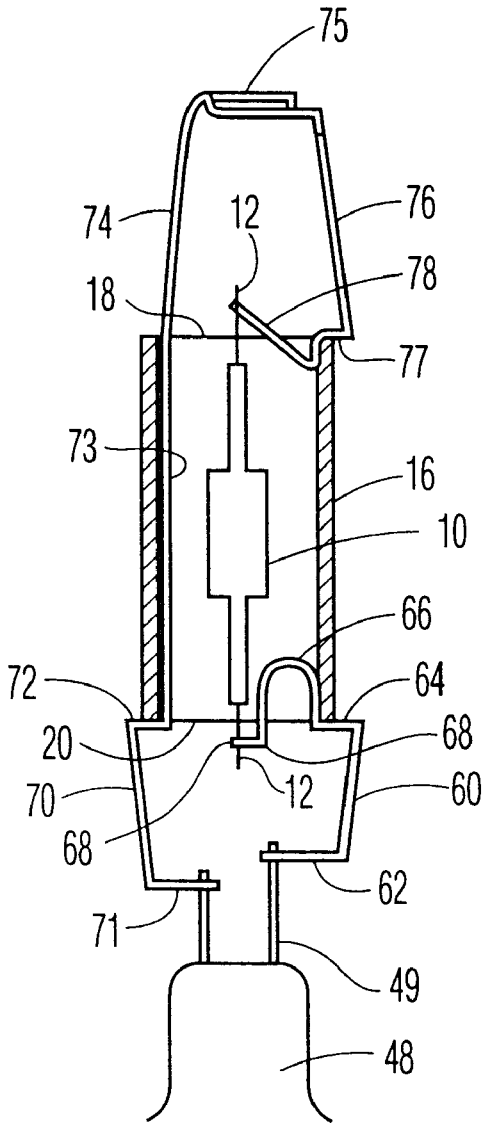
FIG. 2 is a diagrammatic view of an alternative embodiment of frame members.

FIG. 2 shows an alternative arrangement of frame members 60, 70. The short frame member 60 is formed with a lower end 62, a shoulder 64, a bump 66, and a terminal 68. The terminal 68 is welded to lower lead 12 of the arc tube, and the lower end 62 is welded to a lead extending from the stem. The shoulder 64 supports the end 20 of the sleeve 16. The long frame member 70 is formed with the following integral features, in ascending order: a lower end 71, a lower shoulder 72, a straight section 73, a first upper section 74, a retaining loop 75, a second upper section 76, an upper shoulder 77, and a terminal 78. The lower end 71 is welded to a lead embedded in the glass stem. The shoulder 72 (like shoulder 64) supports the bottom end 20 of the arc tube. Straight section 73 extends through the arc tube to a first upper section 74, which slopes toward retaining loop 75. Second upper section 76 slopes outward from loop 75 to upper shoulder 77, which bears against upper end 18 of the quartz sleeve 16. Terminal 78 is welded to the upper lead of the arc tube.

The frame members of FIG. 2 are simpler to manufacture and afford some advantages during assembly. The converging attitude of the frame sections 74, 76 facilitates slipping the sleeve 16 thereover and guides it toward the shoulders 64, 72. These sections are spring loaded outward so that shoulder 77 snaps into place. Likewise the bump 66 and straight section 73 are spring loaded apart to position the sleeve 16.

The lower ends 62, 71 of the respective frame members 60, 70 are bent at right angles with respect to the frame members and welded to the stem leads 49 outside of the stem 48.

This permits a precise positioning of the frame members 60, 70 with respect to each other regardless of the relative positioning of the stem leads. Accordingly close tolerances during the forming of the stem need not be maintained.

Details of the glass envelope and electrical connections in FIG. 2 are the same as in FIG. 1.

The foregoing is exemplary and not intended to limit the scope of the claims which follow.

What is claimed is:

1. A lamp of the type comprising a light source having a pair of opposed leads, a protective sleeve around the light source, said sleeve having a pair of opposed ends, a metal frame supporting said sleeve, and a glass envelope, wherein said frame comprises a pair of frame members received inside said protective sleeve, one of said frame members extending through said sleeve.

2. A lamp as in claim 1 wherein said frame members have respective portions which are substantially parallel inside of said protective sleeve.

3. A lamp as in claim 1 wherein said frame members are spring loaded outward against said protective sleeve.

4. A lamp as in claim 1 wherein said light source is a metal halide arc tube.

5. A lamp as in claim 4 wherein said arc tube comprises an aluminum oxide envelope and a metal halide filling.

6. A lamp as in claim 1 further comprising a pair of terminals connected to said leads of said light source, said terminals being fixed to said frame members.

7. A lamp as in claim 6 wherein one of said terminals extends laterally of the respective said frame member and bears against an end of said protective sleeve.

8. A lamp as in claim 1 further comprising a getter fixed to one of said frame members, said getter bearing against one of said ends of said protective sleeve.

9. A lamp as in claim 1 further comprising a glass stem in which said frame members are embedded.

10. A lamp as in claim 1 wherein said envelope has a top end with an internal dimple, said one of said frame members extending through said protective sleeve having retention means integral therewith for cooperating with said dimple to fix the position of said one of said frame members with respect to said envelope.

11. A lamp as in claim 1 wherein said one of said frame members is a long frame member, and the other of said frame members is a short frame member which extends only partially into said protective sleeve.

12. A lamp as in claim 11 wherein said long frame member is formed with a pair of shoulders, each said shoulder bearing against a respective end of said sleeve to position said sleeve with respect to said long frame member.

13. A lamp as in claim 12 wherein said short frame member is formed with a shoulder which bears against one of said ends.

14. A lamp as in claim 1 wherein at least one of said frame members is formed with an integral shoulder which bears against one of said ends of said protective sleeve.

15. A lamp as in claim 14 wherein each of said frame members is formed with a shoulder which bears against a respective said end of said sleeve.

16. A lamp as in claim 11 wherein at least one of said frame members is formed with an integral terminal which is connected to a respective said electrode.

17. A lamp as in claim 16 wherein each of said frame members is formed with an integral terminal which is connected to a respective said electrode.

18. A lamp comprising a light source having a pair of opposed leads, a protective sleeve around the light source, said sleeve having an upper end and a lower end, a metal frame supporting said sleeve, said frame comprising a pair of frame members received inside said protective sleeve, each said frame member having an integral shoulder which supports said lower end of said sleeve.

* * * * *